US007589703B2

(12) United States Patent
Su

(10) Patent No.: US 7,589,703 B2
(45) Date of Patent: Sep. 15, 2009

(54) LIQUID CRYSTAL DISPLAY WITH SUB-PIXEL STRUCTURE

(75) Inventor: Jenn-Jia Su, Budai Township, Chiayi County (TW)

(73) Assignee: AU Optronics Corporation, Hsinchu (TW)

( * ) Notice: Subject to any disclaimer, the term of this patent is extended or adjusted under 35 U.S.C. 154(b) by 712 days.

(21) Appl. No.: 11/405,974

(22) Filed: Apr. 17, 2006

(65) Prior Publication Data

US 2007/0242009 A1 Oct. 18, 2007

(51) Int. Cl.
*G09G 3/36* (2006.01)

(52) U.S. Cl. ..... 345/87; 345/38; 345/43; 345/88; 345/92; 345/93; 345/103; 345/695; 349/38; 349/114; 349/143; 349/144; 349/147

(58) Field of Classification Search ..... 345/38, 345/43, 87, 88, 92, 93, 103, 695; 349/38, 349/114, 143, 144, 147
See application file for complete search history.

(56) References Cited

U.S. PATENT DOCUMENTS

| | | | | |
|---|---|---|---|---|
| 4,775,861 | A | 10/1988 | Saito | 340/784 |
| 5,164,851 | A | 11/1992 | Kanemori et al. | 359/59 |
| 5,260,818 | A | 11/1993 | Wu | 359/59 |
| 5,317,437 | A | 5/1994 | Katakura | 359/87 |
| 6,704,066 | B2 | 3/2004 | Tsumura et al. | 349/42 |
| 6,704,067 | B2 | 3/2004 | Tsumura et al. | 349/42 |
| 6,791,633 | B2 | 9/2004 | Matsumoto | 349/42 |
| 6,819,309 | B1 * | 11/2004 | Kishi | 345/87 |
| 6,862,052 | B2 | 3/2005 | Kim | 349/54 |
| 6,897,909 | B2 | 5/2005 | Ochiai et al. | 349/43 |
| 2003/0227429 | A1 * | 12/2003 | Shimoshikiryo | 345/90 |
| 2005/0030458 | A1 | 2/2005 | Sasabayashi et al. | 349/129 |
| 2005/0030460 | A1 | 2/2005 | Kim et al. | 349/139 |
| 2005/0094078 | A1 * | 5/2005 | Kang | 349/141 |
| 2005/0122441 | A1 | 6/2005 | Shimoshikiryoh | 349/38 |
| 2005/0179853 | A1 | 8/2005 | Chen et al. | 349/155 |

* cited by examiner

*Primary Examiner*—Richard Hjerpe
*Assistant Examiner*—Saifeldin Elnafia
(74) *Attorney, Agent, or Firm*—Ware, Fressola, Van Der Sluys & Adolphson, LLP

(57) ABSTRACT

A liquid-crystal display wherein each color sub-pixel is divided into at least a first region and a second region, each region having a pair of electrodes and a storage capacitor. The lower electrode in each region is connected to the same gate line via a different TFT. The upper electrode in each region is connected to a different common line to receive a different voltage signal. Each of the voltage signals comprises a common component and a different signal component. The different signal components are periodical in a "swing" fashion. These signals are in-sync with each other but with different polarity. When the sub-pixel is divided into three regions, the voltage signal in the third common line is equal to the common component. When suitable swing signals in positive frames and negative frames are applied to the regions in sub-pixels, different pixel inversion effects can be achieved.

17 Claims, 12 Drawing Sheets

LIQUID CRYSTAL DISPLAY WITH SUB-PIXEL STRUCTURE

FIELD OF THE INVENTION

The present invention relates generally to a liquid crystal display and, more particularly, to driving the sub-pixels in the liquid crystal display.

BACKGROUND OF THE INVENTION

As known in the art, a color liquid crystal display (LCD) panel 1 has a two-dimensional array of pixels 10, as shown in FIG. 1. Each of the pixels comprises a plurality of sub-pixels, usually in three primary colors of red (R), green (G) and blue (B). These RGB color components can be achieved by using respective color filters. FIG. 2 illustrates a plan view of the pixel structure in a conventional transmissive LCD panel. As shown in FIG. 2, a pixel can be divided into three sub-pixels 12R, 12G and 12B. The structure of a typical transmissive LCD sub-pixel is shown in FIG. 3. As shown, the LCD sub-pixel comprises a color filter 42 and an ITO electrode 44 disposed on an upper substrate 40. In the lower section of the LCD sub-pixel, a lower transmissive electrode 64, a passivation layer 65 and a device layer 62 are disposed on a lower substrate 60. The sub-pixel 12 further comprises a liquid crystal layer 50 disposed between the upper and lower electrodes. The upper electrode is typically connected to a common line where the voltage is denoted by Vcom (see FIG. 5). As shown in FIG. 4, the lower electrode is electrically connected to a data line m through a switching element or thin-film transistor (TFT), which is turned on by a signal on the gate line n−1. The equivalent circuit of the sub-pixel 12 is shown in FIG. 5. Typically, the sub-pixel 12 is associated with a number of capacitors. $C_{LC}$ is the charge capacitance of the liquid crystal layer in the sub-pixel; $C_{ST}$ is a charge storage capacitor fabricated in the sub-pixel in order to maintain the voltage potential between the upper and lower electrodes after the gate line signal has passed; and $C_{gs}$ is the gate-source capacitance, which is related to one of the capacitors associated with the TFT and the passivation layer (not shown) in the sub-pixel. When the gate line signal is "on", it drives the TFT to charge up these capacitors so that the voltage level (or $V_{PIXEL}$) on the transmissive electrode 64 (see FIGS. 3 and 4) is substantially equal to the signal on data line m, at least before the gate line signal has passed. Depending on the design of the LCD sub-pixel, $V_{PIXEL}$ is typically reduced by an amount known as the feed-through voltage drop. In a conventional LCD panel such as a Multi-domain Vertical Alignment (MVA) panel, the color of the display varies significantly with the view angles due to the changes in the gamma curve.

It is thus desirable and advantageous to provide a method and pixel structure for reducing the effect of viewing angles on the color of a LCD panel.

SUMMARY OF THE INVENTION

A transmissive liquid-crystal display has a pixel structure wherein each pixel is divided into at least a first region and a second region, each region having a pair of electrodes. The electrode pair in the first region comprises a first electrode connected to a gate line via a TFT and a second electrode connected to a first voltage via a first common line. The electrode pair in the second region comprises a first electrode connected to the same gate line via another TFT, and a second electrode connected to a second voltage via a second common line. Each of the first and second voltages has a common signal and a different signal. The different signals are periodical and in a "swing' fashion. These signals are in-sync with each other but with a different polarity. Each region also has a storage capacitor connected to a third common line connected to a third voltage, which is substantially equal to the average of the first and second voltages.

Alternatively, each pixel has a first capacitor operatively connected between the first electrode in the first region and the first common line, and a second capacitor operatively connected between the first electrode in the second region and the second common line.

In another embodiment, a pixel also has a third region. The third region has a third electrode pair. The third electrode pair comprises a first electrode connected to the same gate line via a different TFT, and a second electrode connected to a third voltage via a third common line, wherein the third voltage is substantially equal to the average of the first and second voltages. Each of the regions has a storage capacitor connected in parallel to the respective electrode pair.

The present invention will become apparent upon reading the description taken in conjunction with FIGS. 6 to 19*c*.

BRIEF DESCRIPTION OF THE DRAWINGS

FIGS. 10*a*-10*h* show a timing chart with various signals associated with a sub-pixel, according to the present invention, wherein:

FIG. 10*a* shows the signal on gate line n−1;

FIG. 10*b* shows the signal on gate line n;

FIG. 10*c* shows the signal on gate line n+1;

FIG. 10*d* shows the signal on common line 1;

FIG. 10*e* shows the signal on common line 2;

FIG. 10*f* shows the signal on data line m;

FIG. 10*g* shows the signal $V_{PIXEL1}$, and

FIG. 10*h* shows the signal $V_{PIXEL2}$.

FIGS. 14*a*-14*j* show a timing chart with various signals associated with a sub-pixel as shown in FIG. 13, wherein:

FIG. 14*a* shows the signal on gate line n−1;

FIG. 14*b* shows the signal on gate line n;

FIG. 14*c* shows the signal on gate line n+1;

FIG. 14*d* shows the signal on common line 1;

FIG. 14*e* shows the signal on common line 2;

FIG. 14*f* shows the signal on common line 3;

FIG. 14*g* shows the signal on data line in;

FIG. 14*h* shows the signal $V_{PIXEL1}$;

FIG. 14*i* shows the signal $V_{PIXEL2}$; and

FIG. 14*j* shows the signal $V_{PIXEL3}$.

FIGS. 16*a*-16*h* show a timing chart with various signals associated with a sub-pixel, according to another embodiment of the present invention, wherein:

FIG. 16*a* shows the signal on gate line n−1;

FIG. 16*b* shows the signal on gate line n;

FIG. 16*c* shows the signal on gate line n+1;

FIG. 16*d* shows the signal on common line 1;

FIG. 16*e* shows the signal on common line 2;

FIG. 16*f* shows the signal on data line in;

FIG. 16*g* shows the signal $V_{PIXEL1}$, and

FIG. 16*h* shows the signal $V_{PIXEL2}$.

FIGS. 17*a*-17*e* show the relationship between the signals $V_{PIXEL1}$ and $V_{PIXEL2}$ and the Vcom swing; wherein FIG. 17*a* shows an example of a constant Vcom signal;

FIG. 17*b* shows an example of Vcom signal of common line 1;

FIG. 17*c* shows an example of Vcom signal of common line 2;

FIG. 17*d* shows an example of $V_{PIXEL1}$ in two-frame time; and

FIG. 17*e* shows an example of $V_{PIXEL2}$ in two-frame time.

DETAILED DESCRIPTION OF THE INVENTION

Figure 1:
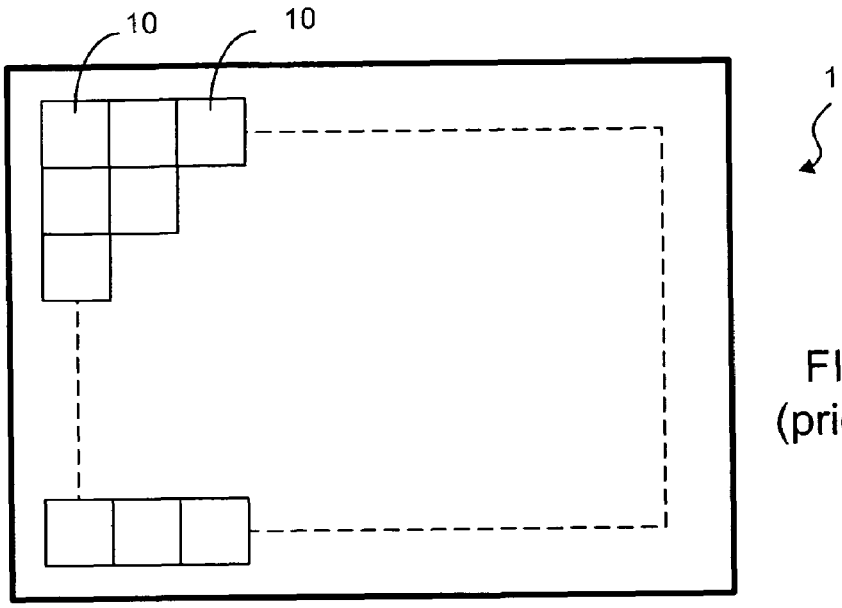
FIG. 1 (prior art)
FIG. 1 is a schematic representation showing a typical LCD panel.
Figure 2:
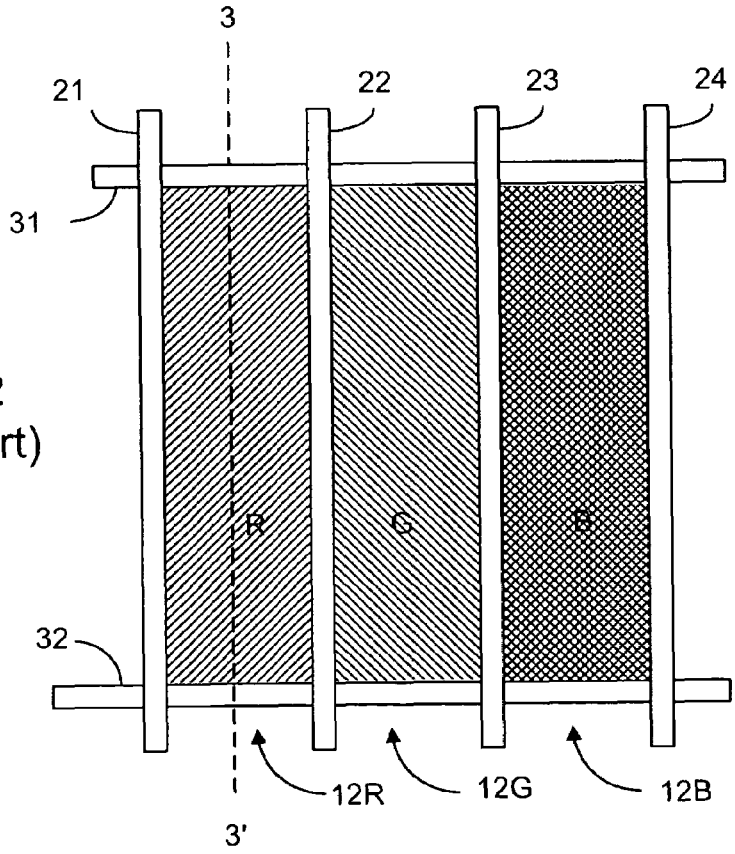
FIG.2 (prior art)
FIG. 2 is a schematic representation showing a plan view of the pixel structure in a typical LCD panel.
Figure 3:
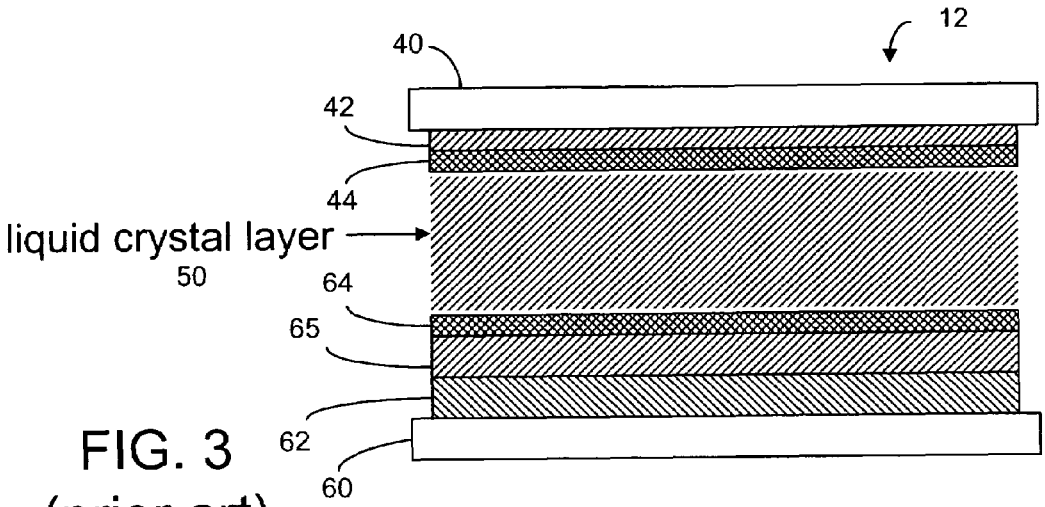
FIG. 3 (prior art)
FIG. 3 is a schematic representation showing a cross sectional view of the sub-pixel.
Figure 4:
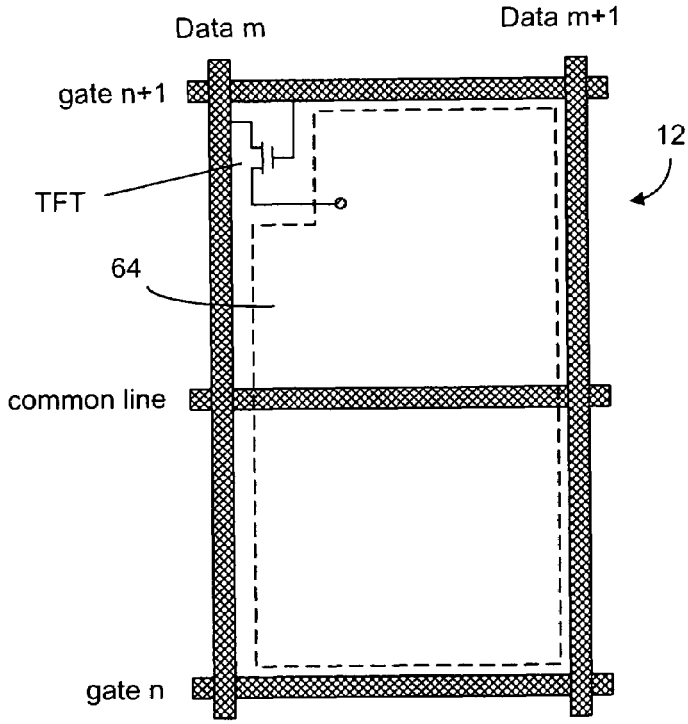
FIG. 4 (prior art)
FIG. 4 is a schematic representation showing the electrical connections on the lower electrode in a prior art sub-pixel.
Figure 5:
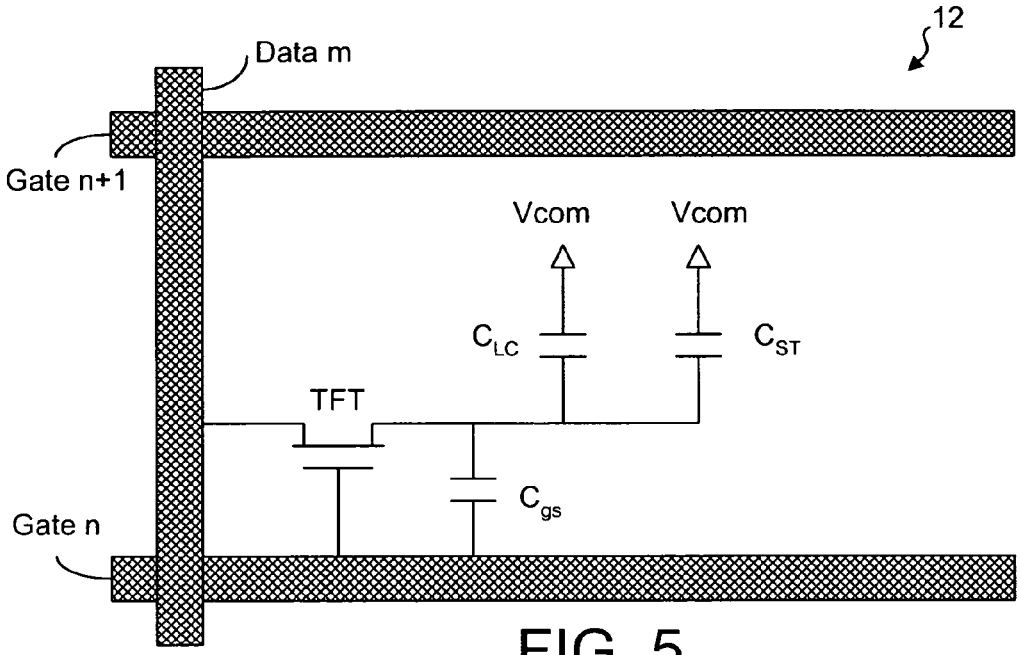
FIG. 5 (prior art)
FIG. 5 is an equivalent circuit of the prior art sub-pixel as shown in FIG. 4.
Figure 6:
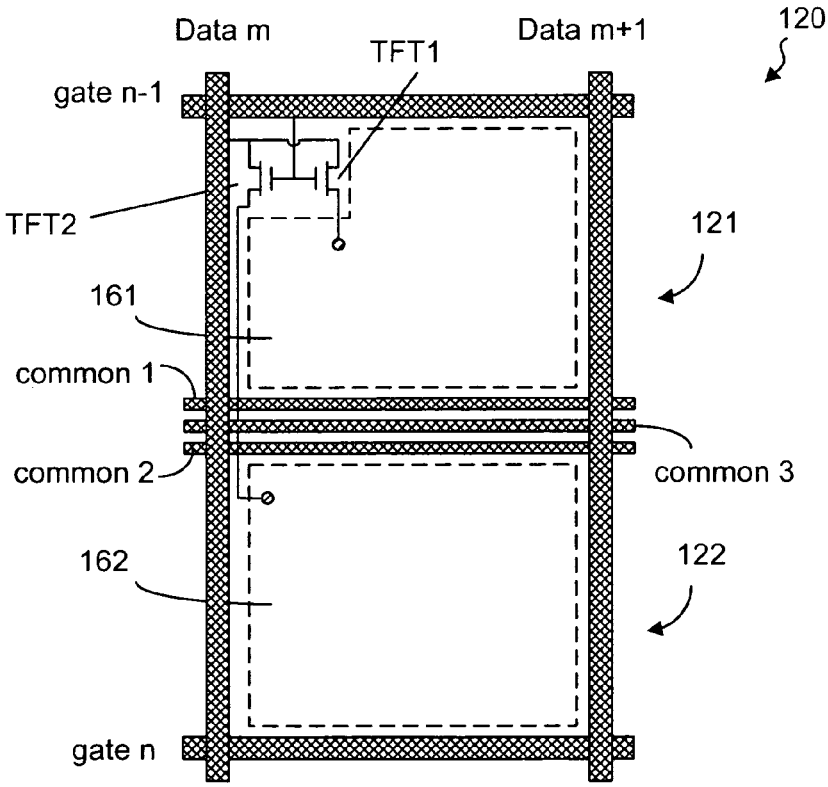
FIG. 6 is a schematic representation showing the electrical connections on the lower electrode in a sub-pixel, according to the present invention.
Figure 7A:
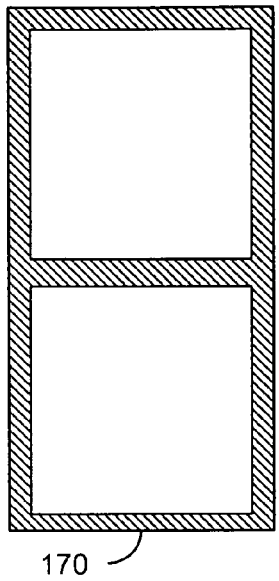
FIG. 7*a* shows a masking layer disposed on a color sub-pixel, according to the present invention.
Figure 7B:
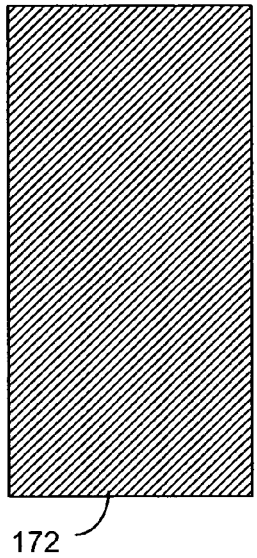
FIG. 7*b* shows a color filter disposed on a color sub-pixel, according to the present invention.
Figure 7C:
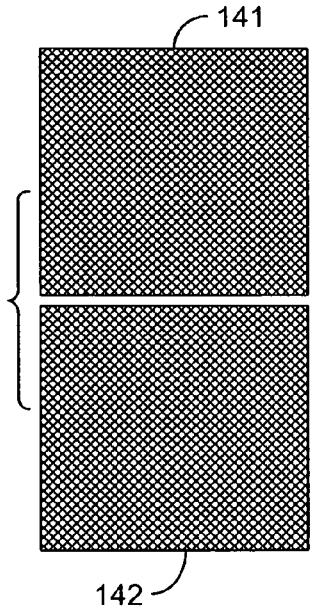
FIG. 7*c* shows a pair of upper electrodes disposed on a color sub-pixel, according to the present invention.
Figure 8:
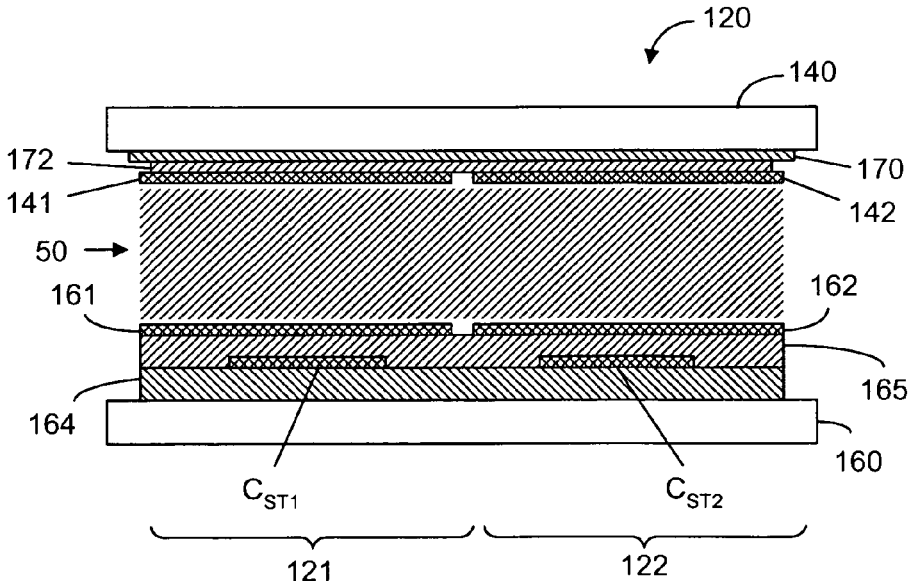
FIG. 8 is a schematic representation showing a cross sectional view of a color sub-pixel, according to the present invention.

In an LCD panel of the present invention, a color sub-pixel is further divided into two or more regions. As shown in FIG. 6, a color sub-pixel 120 is divided into two sub-regions 121, 122, for example. Each of the sub-regions has a lower electrode. As shown in FIG. 6, region 121 has a lower electrode 161 electrically connected to Data line m through a switching element TFT1. Region 122 has a lower electrode 162 electrically connected to Data line m through another switching element TFT2. Both TFT1 and TFT2 are activated or turned on by the signal on Gate line n−1. Furthermore, the sub-pixel 120 is associated with two common lines: common 1 and common 2 for separately providing a voltage level to the upper electrodes 141, 142 (see FIG. 8). Optionally, the sub-pixel is also associated to another common line 3. In order to improve the viewing quality of the LCD panel, each color sub-pixel has a mask 170 made of an opaque material, as shown in FIG. 7*a*. Furthermore, the sub-pixel has a color filter 172 as shown in FIG. 7*b*. In contrast to the prior art LCD panel, the sub-pixel has two upper electrodes 141, 142 as shown in FIG. 7*c*. These electrodes are separately connected to common line 1 and common line 2. As shown in FIG. 8, the mask 170 can be disposed on the upper substrate 140. The color filter 172 and the electrodes 141, 142 can be disposed on the mask 170. In the lower part of the color sub-pixel 120, the lower electrodes 161, 162, a passivation layer 165 and a device layer 164 can be disposed on a lower substrate 160.

Figure 9:
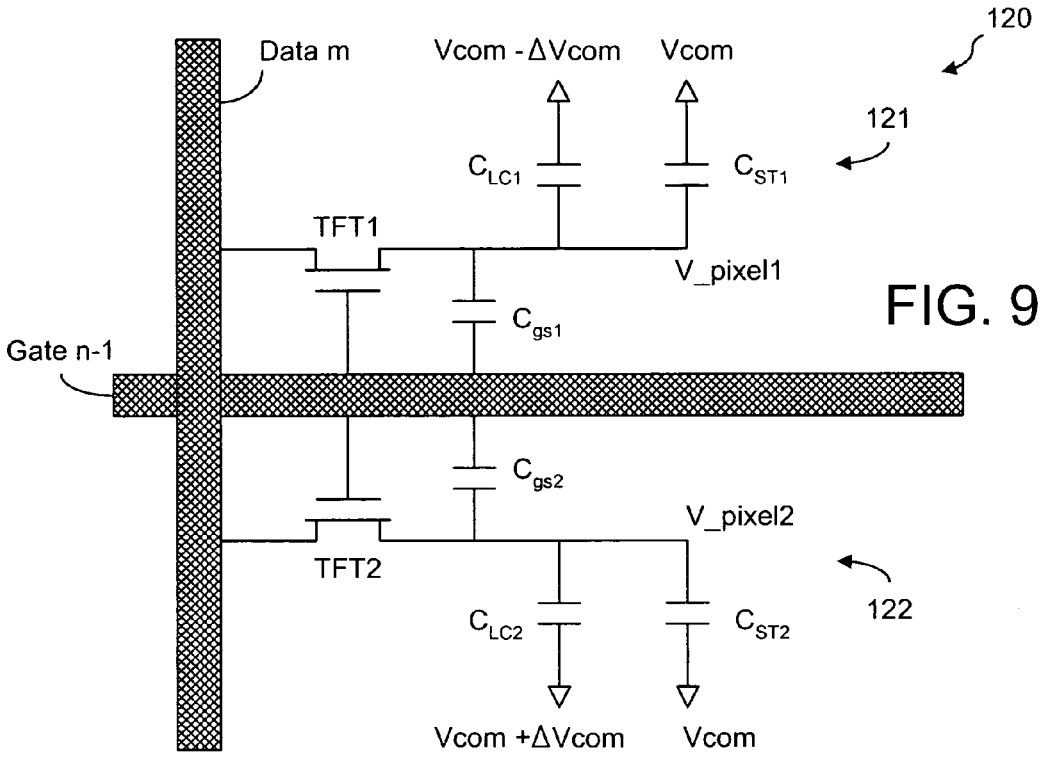
FIG. 9 is an equivalent circuit of a sub-pixel, according to the present invention.

Furthermore, sub-region 121 is associated with a charge storage capacitor $C_{ST1}$ and other capacitors ($C_{gs1}$ for example). Likewise, sub-region 122 is associated with a charge storage capacitor $C_{ST2}$ and other capacitors ($C_{gs2}$ for example). Both the charge storage capacitors $C_{ST1}$, $C_{ST2}$ are connected to a common voltage Vcom (common 3 in FIG. 6) which has a constant voltage level. As shown in FIG. 9, the upper electrode 141 is electrically connected to Common 1 and the upper electrode 142 is electrically connected to Common 2.

The signals at various gate, data and common lines are shown in FIGS. 10*a*-10*h*. FIG. 10*a* shows the signal on gate line n−1; FIG. 10*b* shows the signal on gate line n; and FIG. 10*c* shows the signal on gate line n+1. The sub-pixel 120 depicted in FIG. 9 is driven by gate line n−1. FIGS. 10*d* and 10*e* show the signal on common line 1 and common line 2. As shown, the signals on the common lines are periodical in a "swing" fashion. The signals are in-sync with each other but with different polarity. FIG. 10*f* shows the signal on Data line m. As shown, the signal level on the data line may have different values, but only the signal level V_signal during Gate line n−1 determines the voltage potential on the electrodes in sub-region 121 and the electrodes in sub-region 122. The applied voltage $V_{PIXEL1}$ on electrode 161 in sub-region 121 is shown in FIG. 10*g*. The applied voltage $V_{PIXEL2}$ on electrode 162 in sub-region 122 is shown in FIG. 10*h*.

The one frame time root-mean squared voltage potential $V_{PIXEL1}$ between electrodes 161 and 141 in sub region 121 and the one frame time root-mean squared voltage potential $V_{PIXEL2}$ between electrodes 161 and 141 in sub region 121 are given by:

$$V_{PIXEL1_RMS}=V_\text{signal}+(\Delta Vcom/2)\times(C_{LC1}/(C_{LC1}+C_{ST1}+C_{others})) \quad (1)$$

$$V_{PIXEL2_RMS}=V_\text{signal}-(\Delta Vcom/2)\times(C_{LC2}/(C_{LC2}+C_{ST2}+C_{others})) \quad (2)$$

where $C_{others}$ include $C_{gs}$ and capacitance associated with the switching element and the passivation layers in the sub-region.

Figure 11:
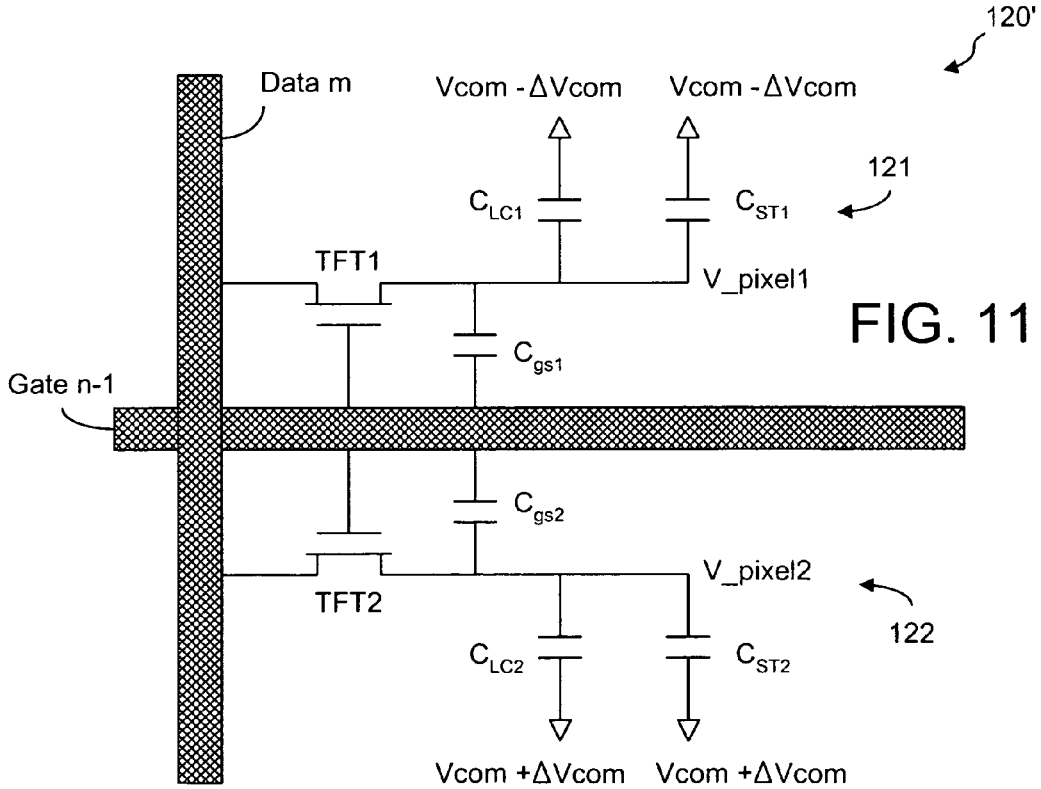
FIG. 11 is an equivalent circuit of a sub-pixel, according to another embodiment of the present invention.

In another embodiment of the present invention, both $C_{LC}$ and $C_{ST}$ in the same sub-region are connected to the same common line. As shown in FIG. 11, $C_{LC1}$ and $C_{ST1}$ in sub-region 121 are connected to common line 1 and $C_{LC2}$ and $C_{ST2}$ in sub-region 122 are connected to common line 2. The voltage potential $V_{PIXEL1}$ and the voltage potential $V_{PIXEL2}$ are given by:

$$V_{PIXEL1}=V_\text{signal}+\Delta Vcom\times(C_{LC1}+C_{ST1})/(C_{LC1}+C_{ST1}+C_{others}) \quad (4)$$

$$V_{PIXEL2}=V_\text{signal}-\Delta Vcom\times(C_{LC2}+C_{ST2})/(C_{LC2}+C_{ST2}+C_{other}) \quad (5)$$

and the rms (root-mean squared) value of the second term in the above equations is $$(\Delta Vcom/2)\times(C_{LC}+C_{ST})/(C_{LC}+C_{ST}+C_{others}) \quad (6)$$

Because of the inclusion of the charge storage capacitance term in the equations, the coupling voltage on common line 1 and common line 2 is less sensitive to the $C_{LC}$ value. This allows a higher fabrication margin in the making of the LCD panel. At the same time, the magnitude of ΔVcom can be reduced.

Figure 12:
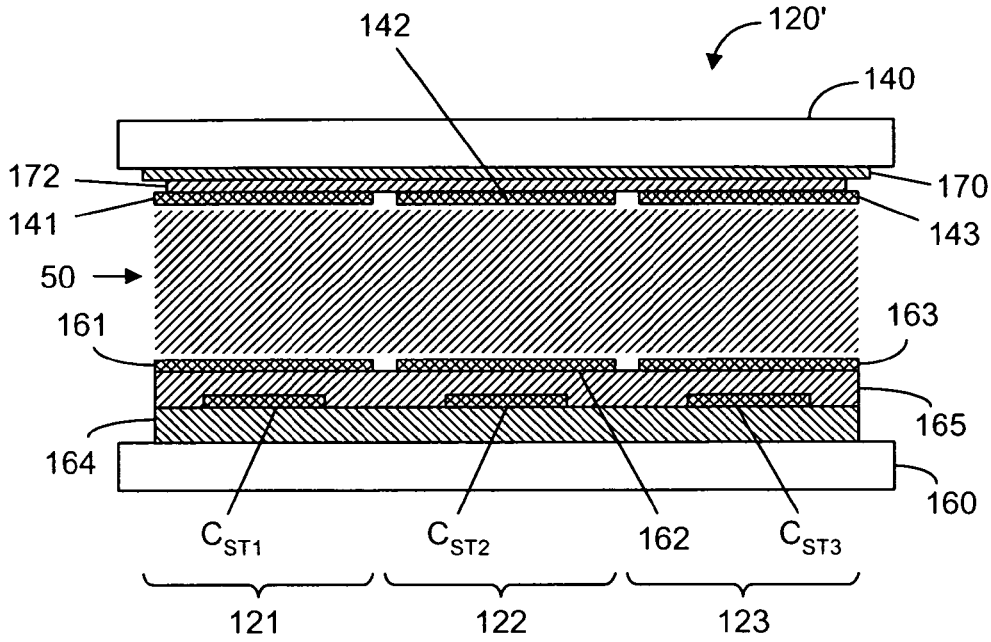
FIG. 12 is a schematic representation showing a cross sectional view of a color sub-pixel, according to a different embodiment of the present invention.
Figure 13:
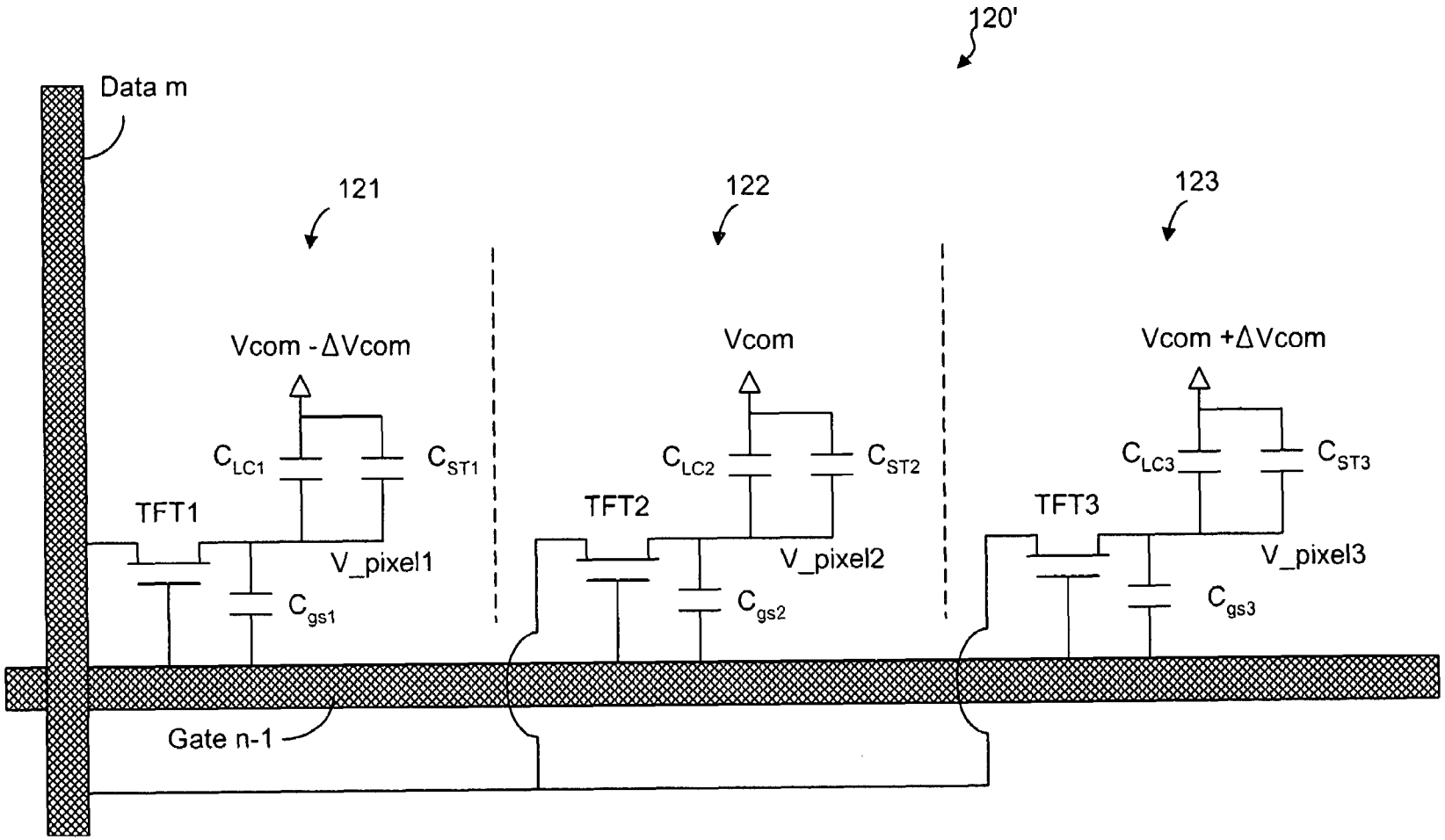
FIG. 13 is an equivalent circuit of the sub-pixel as shown in FIG. 11.

A color sub-pixel can also be divided into three sub-regions. As shown in FIG. 12, the sub-pixel 120' has three sub-regions 121, 122 and 123 defined by the upper electrodes 141, 142, 143 and the lower electrodes 161, 162, 163. For example, the upper electrodes 141, 142 and 143 can be electrically connected to common line 1, common line 3 and common line 2, respectively. Likewise, the charge storage capacitors $C_{ST1}$, $C_{ST2}$ and $C_{ST3}$ are separately connected to common line 1, common line 3 and common line 2, respectively, as shown in FIG. 13. Accordingly, the voltage potentials $V_{PIXEL1}$ $V_{PIXEL2}$ and $V_{PIXEL3}$ are given by:

$$V_{PIXEL1}=V_\text{signal}+\Delta Vcom\times(C_{LC1}+C_{ST1})/(C_{LC1}+C_{ST1}+C_{others}) \quad (7)$$

$$V_{PIXEL2}=V_\text{signal} \quad (8)$$

$$V_{PIXEL3}=V_\text{signal}-\Delta Vcom\times(C_{LC3}+C_{ST3})/(C_{LC3}+C_{ST3}+C_{others}) \quad (9)$$

and the rms value of the second term in the Equations 7 and 9 is $$(\Delta Vcom/2)\times(C_{LC}+C_{ST})/(C_{LC}+C_{ST}+C_{others}) \quad (10)$$

The signals at various gate, data and common lines are shown in FIGS. 14*a*-14*j*. FIG. 14*a* shows the signal on gate line n−1; FIG. 14*b* shows the signal on gate line n; and FIG. 14*c* shows the signal on gate line n+1. FIG. 14*d* shows the signal on common line 1 applied to upper electrode 141 and the charge storage capacitor $C_{ST1}$. FIG. 14*e* shows the signal on common line 2 applied to upper electrode 143 and the charge storage capacitor $C_{ST3}$. FIG. 14*f* shows the signal on common line 3 applied to upper electrode 142 and the charge storage capacitor $C_{ST2}$. As shown, the signals on the common lines 1 and 2 have two voltage levels in an alternate form. The signal on common line 3 is a constant voltage. FIG. 14*g* shows the signal on Data line m. The applied voltage $V_{PIXEL1}$ on electrode 161 in sub-region 121 is shown in FIG. 14*h*. The applied voltage $V_{PIXEL2}$ on electrode 162 in sub-region 122 is shown in FIG. 14*i*. The applied voltage $V_{PIXEL3}$ on electrodes 163 in sub-region 123 is shown in FIG. 14*j*.

Figure 15:
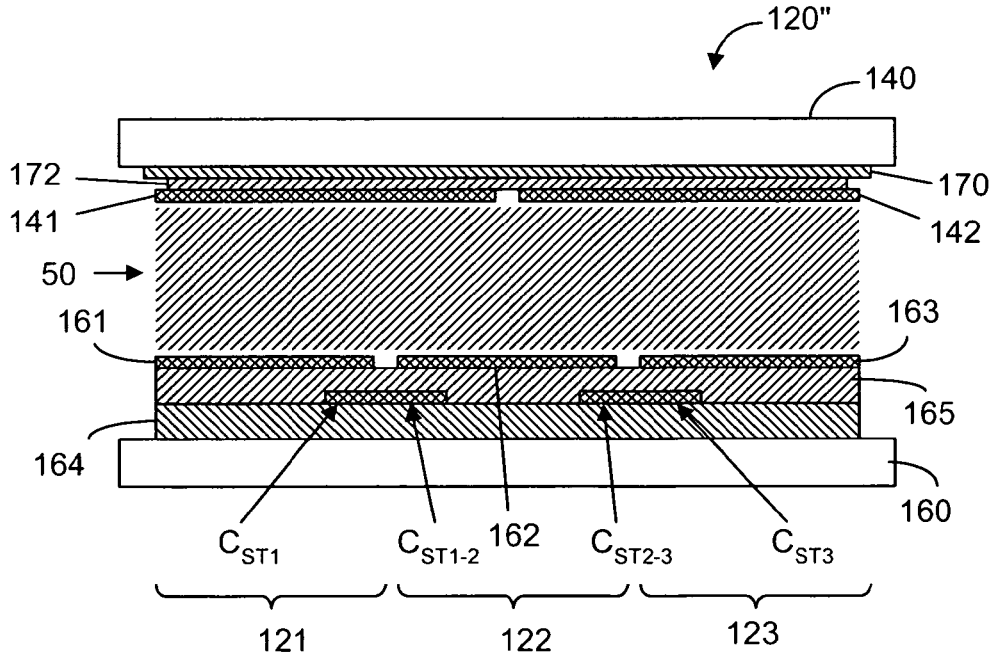
FIG. 15 is a schematic representation showing a cross sectional view of a color sub-pixel, according to another embodiment of the present invention.

In another embodiment of the present invention, the color sub-pixel is also divided into three sub-regions 121, 122 and 123 as shown in FIG. 15. The sub-regions 121, 122 and 123 are defined by the lower electrodes 161, 162 and 163. However, there are only two upper electrodes 141 and 142. There are four charge storage capacitors associated with the sub-pixel 120". $C_{ST1}$ is associated with the lower electrode 161. $C_{ST1\text{-}2}$ is associated with the lower electrode 162. $C_{ST2\text{-}3}$ is associated with the lower electrode 162. $C_{ST3}$ is associated with the lower electrode 163. If both $C_{ST1}$ and $C_{ST1\text{-}2}$ are connected to common line 1 and both $C_{ST2\text{-}3}$ and $C_{ST3}$ are connected to common line 2, the voltage potentials $V_{PIXEL1}$ $V_{PIXEL2}$ and $V_{PIXEL3}$ associated with sub-regions 121, 122 and 123 are given by:

$$V_{PIXEL1}=V_\text{signal}+\Delta Vcom\times(C_{LC1}+C_{ST1})/(C_{LC1}+C_{ST1}+C_{others}) \quad (11)$$

$$V_{PIXEL2}V_\text{signal}+\Delta Vcom[(C_{LC12}+C_{ST1\text{-}2})-(C_{LC23}+C_{ST2\text{-}3})]/(C_{LC12}+C_{ST1\text{-}2}+C_{LC23}+C_{ST2\text{-}3}+C_{others})] \quad (12)$$

$$V_{PIXEL3}=V_\text{signal}-\Delta Vcom\times(C_{LC3}+C_{ST3})/(C_{LC3}+C_{ST3}+C_{others}) \quad (13)$$

In Equation 12, $C_{LC12}$ and $C_{LC23}$ are the capacitance associated with the liquid crystal layer in the sub-region 122. If the design of the sub-regions is such that $C_{LC12}=C_{LC23}$, and $C_{ST1\text{-}2}=C_{ST2\text{-}3}$, Equation 12 is reduced to $$V_{PIXEL2}=V_\text{signal} \quad (12')$$

The rms value of the second term in the Equations 11 and 13 is $$(\Delta Vcom/2)\times(C_{LC}+C_{ST})/(C_{LC}+C_{ST}+C_{others}) \quad (14)$$

It should be noted that, in the embodiment as shown in FIG. 15, the driving waveforms on the three sub-regions are substantially the same as the driving waveforms associated with the embodiment of FIG. 12. The added advantage of the embodiment of FIG. 15 is that that only two common lines, common 1 and common 2, are used. As with the lower electrode 162 in FIG. 12, the lower electrode 162 in FIG. 15 is also connected to the data line via a switching device TFT2 driven by a gate line signal (see FIG. 13).

Figure 10:
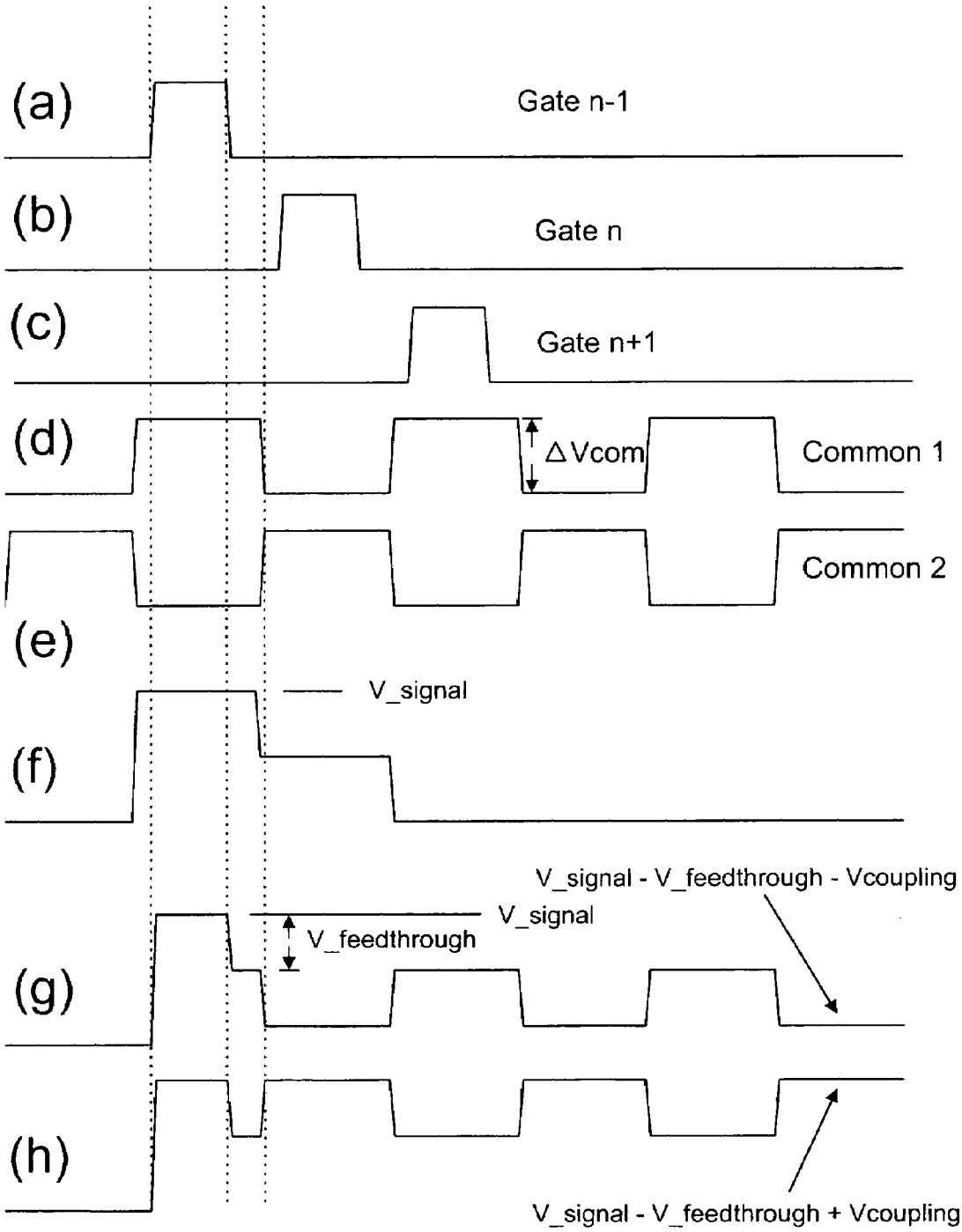
Figure 14:
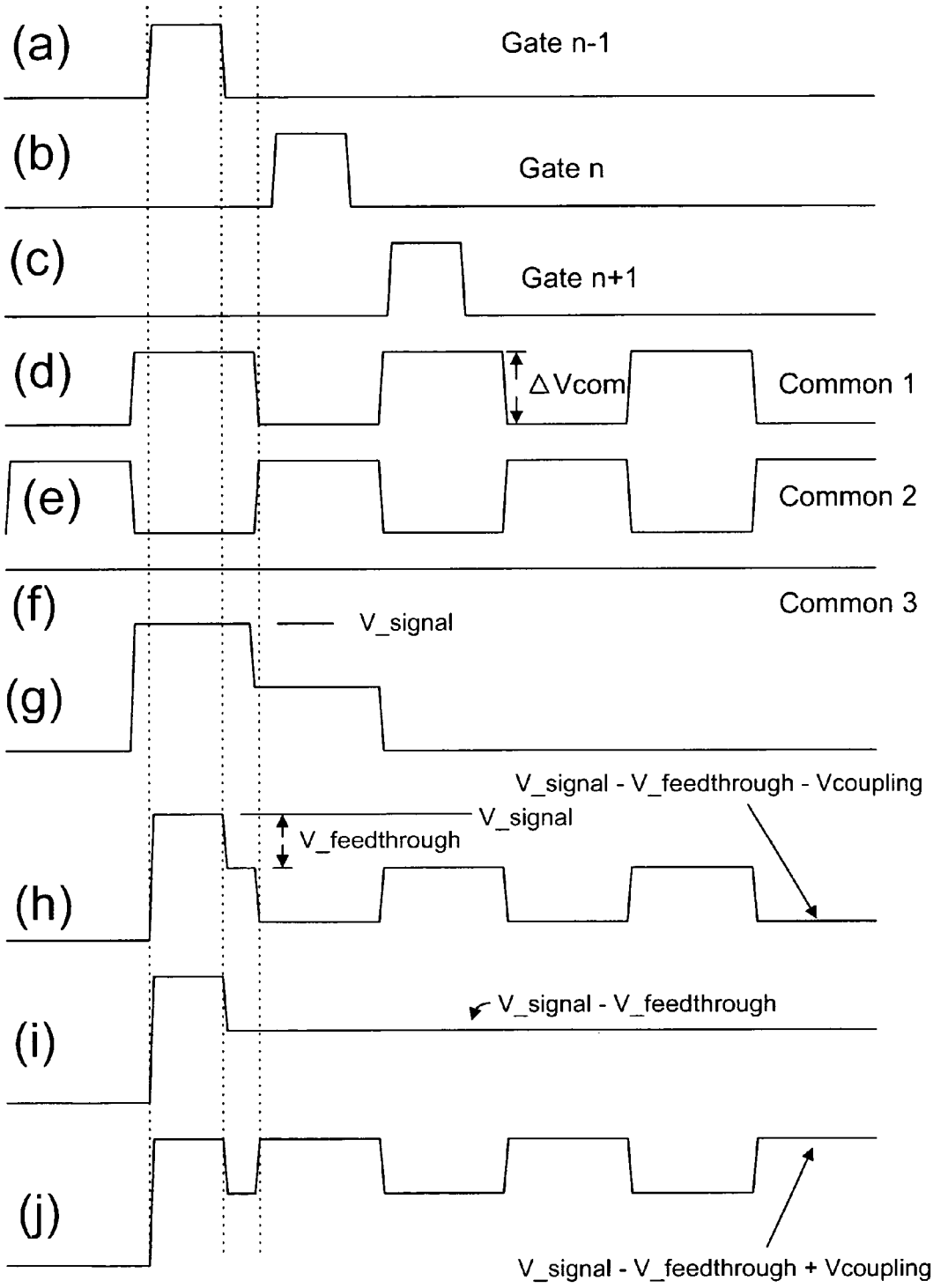
Figure 16:
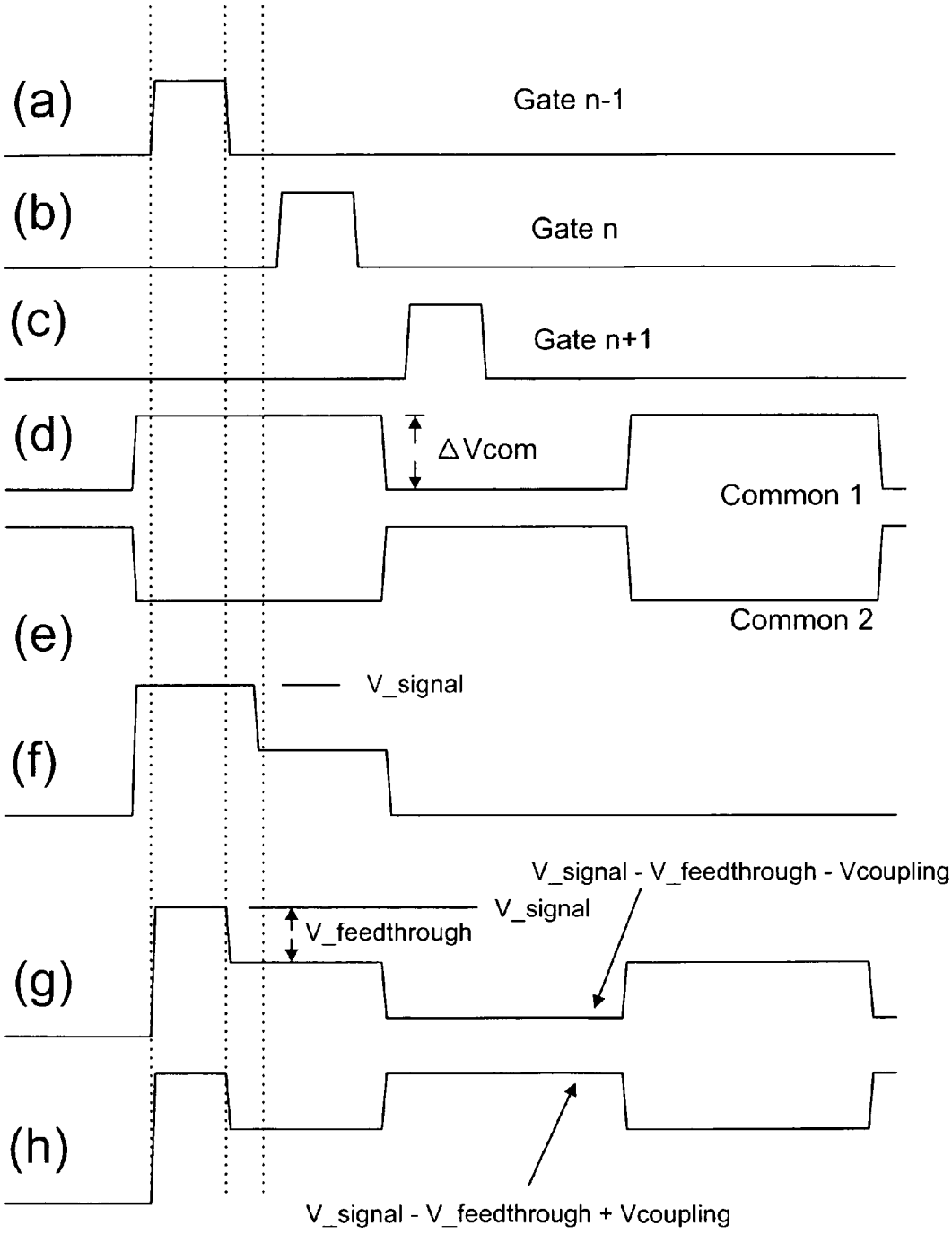

In FIGS. 10 and 14, the signal levels on common lines 1 and 2 change in a swing cycle or period equal to every two gate line signals. It is also possible to double or triple the swing period. As shown in FIG. 16, the period is doubled such that the swing cycle is equal to four gate line signals. FIG. 16*a* shows the signal on gate line n−1; FIG. 16*b* shows the signal on gate line n; and FIG. 16*c* shows the signal on gate line n+1. FIGS. 16*d* and 16*e* show the signal on common line 1 and common line 2. FIG. 16*f* shows the signal on Data line m. The applied voltage $V_{PIXEL1}$ on electrode 161 in sub-region 121 (see FIG. 8) is shown in FIG. 16*g*. The applied voltage $V_{PIXEL2}$ on electrode 162 in sub-region 122 is shown in FIG. 16*h*.

In sum, in an LCD panel of the present invention, a sub-pixel is divided into at least two sub-regions. Each of the sub-regions has a separate electrode pair so that the voltage potential across the liquid crystal layer in one sub-region is different from the voltage potential in the other sub-region. In particular, when each sub-region has a separate upper electrode and a separate lower electrode, the lower electrodes in both sub-regions are connected to the same data line while the upper electrodes in the sub-regions are connected to different common lines. Furthermore, each of the sub-regions has a separate charge storage capacitor. The charge storage capacitors in the sub-regions can be connected to the respective common lines or a different common line. The signals on common line 1 and common line 2 have the same swing waveform alternating between two signal levels, but the polarities are different. As such, when the brightness in one sub-region is reduced, the brightness in the other sub-region is increased.

Figure 17:
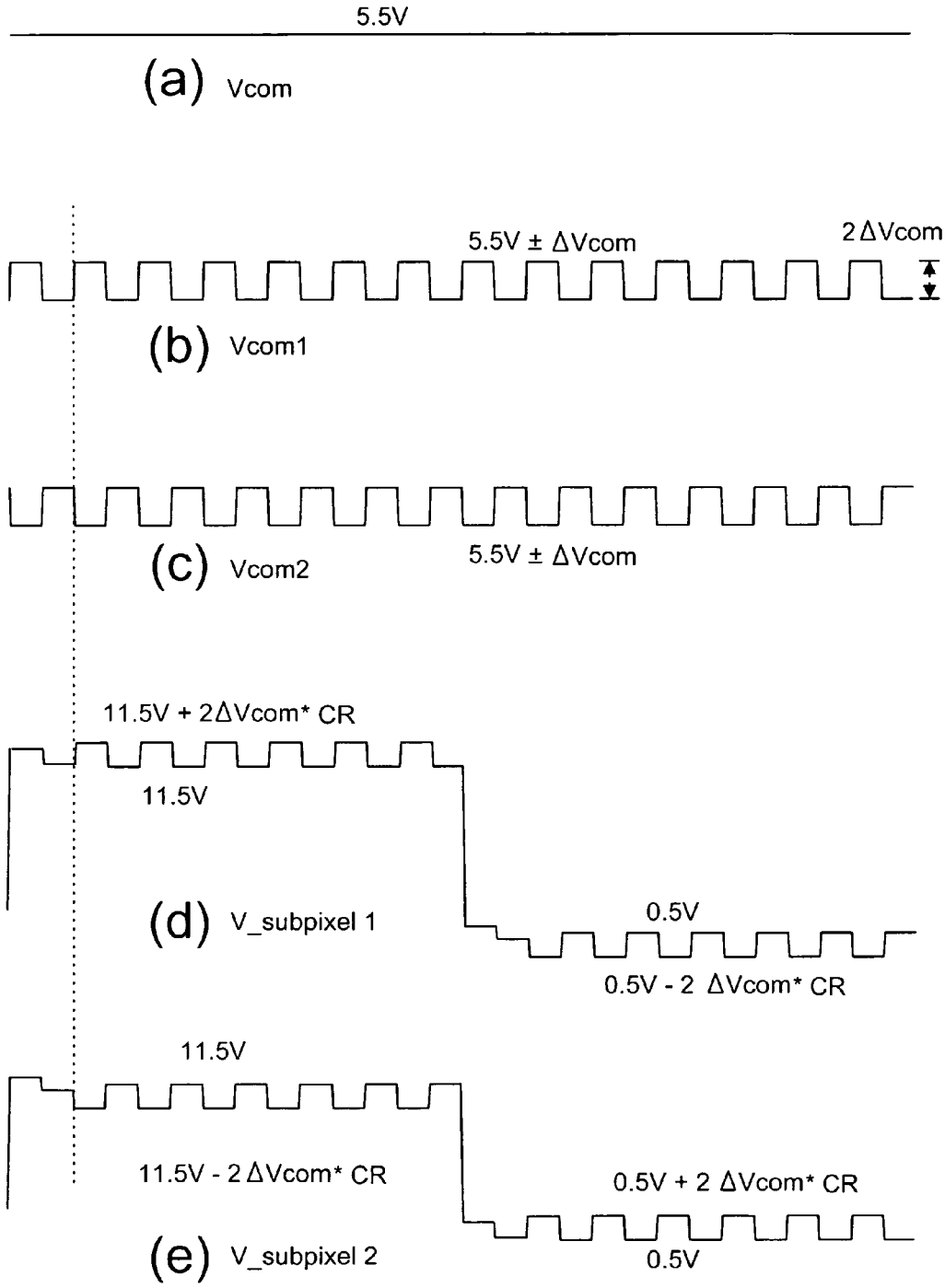

When suitable swing voltage waveforms in positive frames and negative frames are separately provided to the sub-regions in the pixels in LCD panel, different pixel inversion effects can be achieved. FIGS. 17*d* and 17*e* show exemplary waveforms separately provided to sub-region 121 and sub-region 122 of a color sub-pixel 120. The waveform as shown in FIG. 17*d* is similar to the waveform of FIG. 16*h* but it is extended to two-frame time. Likewise, the waveform as shown in FIG. 17*e* is similar to the waveform of FIG. 16*g* but it is extended to two-frame time. If the constant Vcom signal is 5.5V as shown in FIG. 17*a*, then Vcom1, or the swing voltage for sub-region 121 and Vcom2, or the swing voltage for sub-regions 122, are 5.5V plus or minus ΔVcom, as shown in FIGS. 17*b* and 17*c*. Vcom1 and Vcom2 signals are only different in polarity. If V_signal is 6V in a positive frame and −6V in a negative frame, then $V_{PIXEL1}$ alternates between (11.5V+2 ΔVcom×coupling ratio) and 11.5V, $V_{PIXEL2}$ alternates between 11.5V and (11.5V−2 ΔVcom×coupling ratio)

in a positive frame, $V_{PIXEL1}$ alternates between 0.5V and (0.5V−2 ΔVcom×coupling ratio), and $V_{PIXEL2}$ alternates between (0.5V+2 ΔVcom×coupling ratio) and 0.5V in a negative frame. Here the coupling ratio (CR) is $C_{LC1}/(C_{LC1}+C_{ST}+C_{others})$ for sub-region 121 and $C_{LC2}/(C_{LC2}+C_{ST}+C_{others})$ for sub-region 122.

Figure 18A:
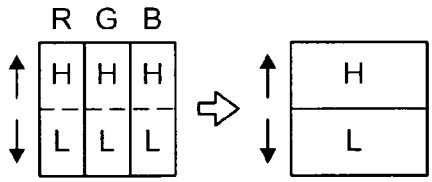
FIG. 18*a* shows a representation of pixel in a positive frame, according to the present invention.
Figure 18B:
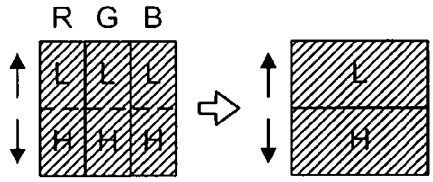
FIG. 18*b* shows a representation of pixel in a negative frame.

FIGS. 18*a* and 18*b* are schematic representations of a pixel in a positive frame and a pixel in a negative frame. The upward pointing arrow indicates a pulled-up V_signal in a sub-region 121 and the downward pointing arrow indicates a pulled-down V_signal in the sub-region 122 of each of the color pixels R, G and B. The letter H indicates the sub-region being brighter because the applied voltage is higher. Likewise, the letter L indicates the sub-region being darker because the applied voltage is lower.

Figure 19A:
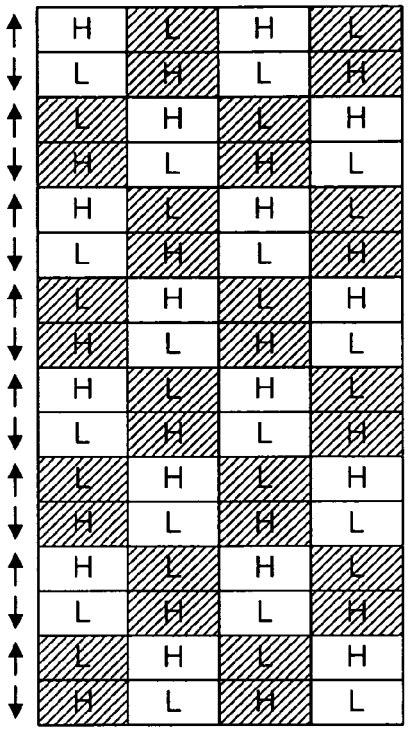
FIG. 19*a* is a schematic representation of dot inversion.
Figure 19B:
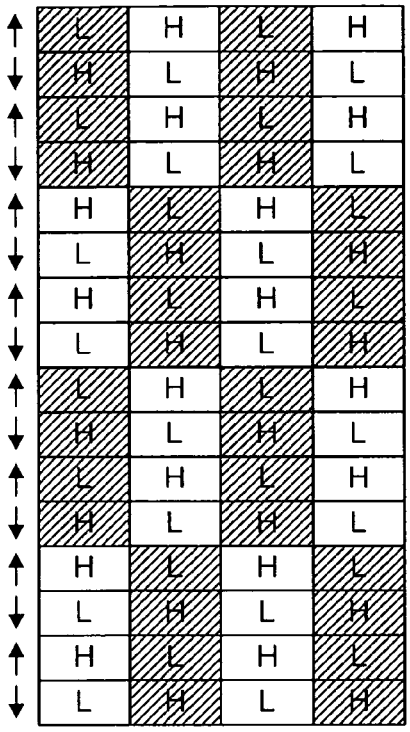
FIG. 19*b* is a schematic representation of two-line inversion.
Figure 19C:
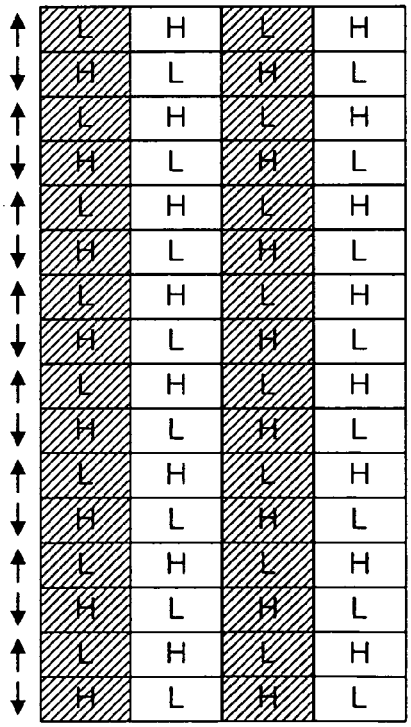
FIG. 19*c* is a schematic representation of column inversion.

It is possible to apply the waveforms $V_{PIXEL1}$ and $V_{PIXEL2}$ on the pixels on an LCD panel to achieve a dot inversion scheme, as shown in FIG. 19*a*. It is also possible to use similar waveforms to achieve a two-line inversion scheme and a row inversion scheme, as shown in FIGS. 19*b* and 19*c*.

Thus, by dividing a color sub-pixel into two sub-regions, with each sub-region having a separate switching element TFT and storage capacitor, it is possible to achieve different pixel inversion schemes using swing voltages in complementary polarities.

It should be noted that the present invention has been disclosed in conjunction with a transmissive LCD panel. However, the present invention is also applicable to a transflective LCD panel as well as a reflective LCD panel.

Thus, although the invention has been described with respect to one or more embodiments thereof, it will be understood by those skilled in the art that the foregoing and various other changes, omissions and deviations in the form and detail thereof may be made without departing from the scope of this invention.

What is claimed is:

1. A method to improve performance of a liquid-crystal display having a liquid crystal layer defining a plurality of pixels, the liquid crystal layer having a first side and an opposing second side, wherein at least some of the pixels comprises a plurality of sub-pixels, each sub-pixel is divided into at least a first region and a second region, and each of the sub-pixels is driven by a gate line and a data line, said method comprising:

disposing a first pair of electrodes on opposing sides of the liquid crystal layer in the first region in each of said sub-pixels, wherein the first pair electrodes comprises a first electrode operatively connected to the data line via a switching device driven by a signal on the gate line, and a second electrode operatively connected to a first common line;

disposing a second pair of electrodes on opposing sides of the liquid crystal in the second region in said sub-pixel, wherein the second pair of electrodes comprises a first electrode operatively connected to the data line via a switching device driven by the signal on the gate line, and a second electrode operatively connected to a second common line;

applying a first voltage to the first common line; and applying a second voltage to the second common line, wherein the second voltage is different from the first voltage by a differential voltage, the differential voltage having a waveform substantially alternating between a first value and a second value.

2. The method of claim 1, wherein the first value is positive and the second value is negative.

3. The method of claim 1, wherein each region in said sub-pixel has a storage capacitor connected to a third common line, said method further comprising:

applying a third voltage to the third common line, such that the third voltage is different from the first and second voltages.

4. The method of claim 3, wherein the third voltage is substantially equal to the average of the first and second voltages.

5. The method of claim 1, wherein said sub-pixel comprises a first pixel capacitor and a first storage capacitor operatively connected between the first electrode in the first region and the first common line, and a second pixel capacitor and a second storage capacitor operatively connected between the first electrode in the second region and the second common line.

6. The method of claim 1, wherein said sub-pixel further comprises a third region, said method further comprising:

disposing a third pair of electrodes on opposing sides of the liquid crystal layer in the third region in said sub-pixel, wherein the third pair of electrodes comprises a first electrode operatively connected to the data line via a switching device driven by the signal on the gate line, and a second electrode operatively connected to a third common line; and applying a third voltage to the third common line, such that the third voltage is different from the first and second voltages.

7. The method of claim 6 wherein the third voltage is substantially equal to the average of the first and second voltages.

8. The method of claim 6, wherein said sub-pixel comprises:

a first pixel capacitor and a first storage capacitor operatively connected between the first electrode in the first region and the first common line;

a second pixel capacitor and a second storage capacitor operatively connected between the first electrode in the second region and the second common line; and a third pixel capacitor and a third storage capacitor operatively connected between the first electrode in the third region and the third common line.

9. The method of claim 1, further comprising:

disposing a third electrode between the first electrode of the first pair of electrodes and the first electrode of the second pair of electrodes; and operatively connecting the third electrode to the data line via a switching device driven by a signal in the gate line.

10. The method of claim 9, wherein said sub-pixel further comprises:

a third region and a fourth region between the first and second regions with the third region adjacent to the first region and the fourth region adjacent to the second region;

a first pixel capacitor and a first storage capacitor operatively connected between the first electrode in the first region and the first common line;

a second pixel capacitor and a second storage capacitor operatively connected between the second electrode in the second region and the second common line;

a third storage capacitor operatively connected between the first electrode in the third region and the first common line; and a fourth storage capacitor operatively connected between the second electrode in the fourth region and the second common line.

11. A liquid crystal display panel comprising:

a liquid crystal layer defining a plurality of pixels, each pixel comprising a plurality of sub-pixels, the liquid crystal layer having a first side and an opposing second side; and a plurality of gate lines and data lines for driving the sub-pixels, wherein at least some of the sub-pixels are divided into at least a first region and a second region, each of said sub-pixels is driven by a gate line and a data line, each said sub-pixel comprising:

a first pair of electrodes disposed on opposing sides of the liquid crystal layer in the first region in each of said sub-pixels, wherein the first pair of electrodes comprises a first electrode operatively connected to the data line via a switching device driven by a signal on the gate line, and a second electrode operatively connected to a first common line; and a second pair of electrodes disposed on opposing sides of the liquid crystal layer in the second region in said sub-pixel, wherein the second pair of electrodes comprises a first electrode operatively connected to the data line via a switching device driven by the signal on the gate line, and a second electrode operatively connected to a second common line, wherein the first common line is connected to a first voltage and the second common line is connected to a second voltage, and wherein the second voltage is different from the first voltage by a differential voltage, the different voltage having a waveform substantially alternating between a first value and a second value.

12. The liquid crystal display panel of claim 11, wherein the first value is positive and the second value is negative.

13. The liquid crystal display panel of claim 11, wherein each region in said sub-pixel has a storage capacitor connected to a third common line, the third common line connected to a third voltage different from the first and second voltages.

14. The liquid crystal display panel of claim 13, wherein the third voltage is substantially equal to the average of the first and second voltages.

15. The liquid crystal display panel of claim 11, wherein each said sub-pixel further comprises:

a first pixel capacitor and a first storage capacitor operatively connected between the first electrode in the first region and the first common line, and a second pixel capacitor and a second capacitor operatively connected between the first electrode in the second region and the second common line.

16. The liquid display crystal panel of claim 11, wherein said sub-pixels are divided into the first region, the second region and a third region, said each sub-pixel further comprises:

a third pair of electrodes disposed on opposing sides of the liquid crystal layer in the third region in said sub-pixel, wherein the third pair of electrodes comprises a first electrode operatively connected to the gate line via a switching device, and a second electrode operatively connected to a third common line, the third common line operatively connected to a third voltage different from the first and second voltages.

17. The liquid crystal display panel of claim 16, wherein said each sub-pixel further comprises:

a first pixel capacitor and a first storage capacitor operatively connected between the first electrode in the first region and the first common line;

a second pixel capacitor and a second capacitor operatively connected between the first electrode in the second region and the second common line; and a third pixel capacitor and a third storage capacitor operatively connected between the first electrode in the third region and the third common line.

* * * * *

UNITED STATES PATENT AND TRADEMARK OFFICE

CERTIFICATE OF CORRECTION

PATENT NO. : 7,589,703 B2
APPLICATION NO. : 11/405974
DATED : September 15, 2009
INVENTOR(S) : Jenn-Jia Su It is certified that error appears in the above-identified patent and that said Letters Patent is hereby corrected as shown below:

1. In column 3, line 9, "in" should be --m--.
2. In column 3, line 24, "in" should be --m--.
3. In column 4, line 55, "—" should be --=--.
4. In column 4, line 59, "other" should be --others--.
5. In column 5, line 61, after "$V_{PIXEL2}$" --=-- should be inserted.

Signed and Sealed this

Sixteenth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,589,703 B2
APPLICATION NO. : 11/405974
DATED : September 15, 2009
INVENTOR(S) : Jenn-Jia Su It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 821 days.

Signed and Sealed this

Twenty-first Day of September, 2010

David J. Kappos

David J. Kappos
*Director of the United States Patent and Trademark Office*